US008243344B2

(12) United States Patent
Bokelman et al.

(10) Patent No.: US 8,243,344 B2
(45) Date of Patent: Aug. 14, 2012

(54) MEDIA DRIVE

(75) Inventors: Kevin L. Bokelman, San Diego, CA (US); Ryan M. Smith, San Diego, CA (US); Gustaf L. Belt, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1628 days.

(21) Appl. No.: 11/618,313

(22) Filed: Dec. 29, 2006

(65) Prior Publication Data

US 2008/0157464 A1 Jul. 3, 2008

(51) Int. Cl.
*H04N 1/04* (2006.01)

(52) U.S. Cl. ..... 358/474; 358/497; 358/498; 358/483

(58) Field of Classification Search ..... 358/474, 358/497, 498, 483, 471; 399/119, 222, 227
See application file for complete search history.

(56) References Cited

U.S. PATENT DOCUMENTS 3,611,431 A * 10/1971 Rosmanith ..... 346/145
402,776 A 6/1977 Crump et al.
448,836 A 12/1984 Yamauchi et al.
4,526,361 A * 7/1985 DuBois ..... 271/186
4,715,597 A * 12/1987 Sakurai ..... 271/122
519,970 A 4/1993 Davis et al.
520,674 A 4/1993 Yamada et al.
527,653 A 1/1994 Hokamura
5,311,330 A 5/1994 Yeh
566,157 A 8/1994 Kameyama et al.
5,538,065 A * 7/1996 G eraud ..... 160/85
5,653,439 A * 8/1997 Rider et al. ..... 271/274
573,992 A 4/1998 Kameyama et al.
576,092 A 6/1998 Howard et al.
589,620 A 4/1999 Kellog et al.
600,280 A 12/1999 Suzuki et al.
602,593 A 2/2000 Ishida
6,089,567 A * 7/2000 Yatsuhashi et al. ..... 271/314
6,181,908 B1 * 1/2001 Leemhuis et al. ..... 399/406
618,540 A1 2/2001 Sueoka
630,765 A1 10/2001 Takaki et al.
6,550,763 B2 * 4/2003 Gordon et al. ..... 271/189
703,103 A1 4/2006 Westeoft et al.
7,068,400 B2 * 6/2006 Su et al. ..... 358/474
7,410,162 B2 * 8/2008 Takasaka et al. ..... 271/160
2003/0178766 A1 * 9/2003 Dirk et al. ..... 271/314
2004/0102275 A1 * 5/2004 Chakraborty et al. ..... 475/225
2005/0212892 A1 * 9/2005 Iso ..... 347/179
2006/0045569 A1 * 3/2006 Okamoto ..... 399/119

* cited by examiner

*Primary Examiner* — Houshang Safaipour

(57) ABSTRACT

Various embodiments and methods relating to a media drive are disclosed.

15 Claims, 4 Drawing Sheets

MEDIA DRIVE

BACKGROUND

Printers, scanners and other media devices sometimes move or drive sheets of media using media drives. Such media drives are costly and space consuming.

DETAILED DESCRIPTION OF THE EXAMPLE EMBODIMENTS

Figure 1:
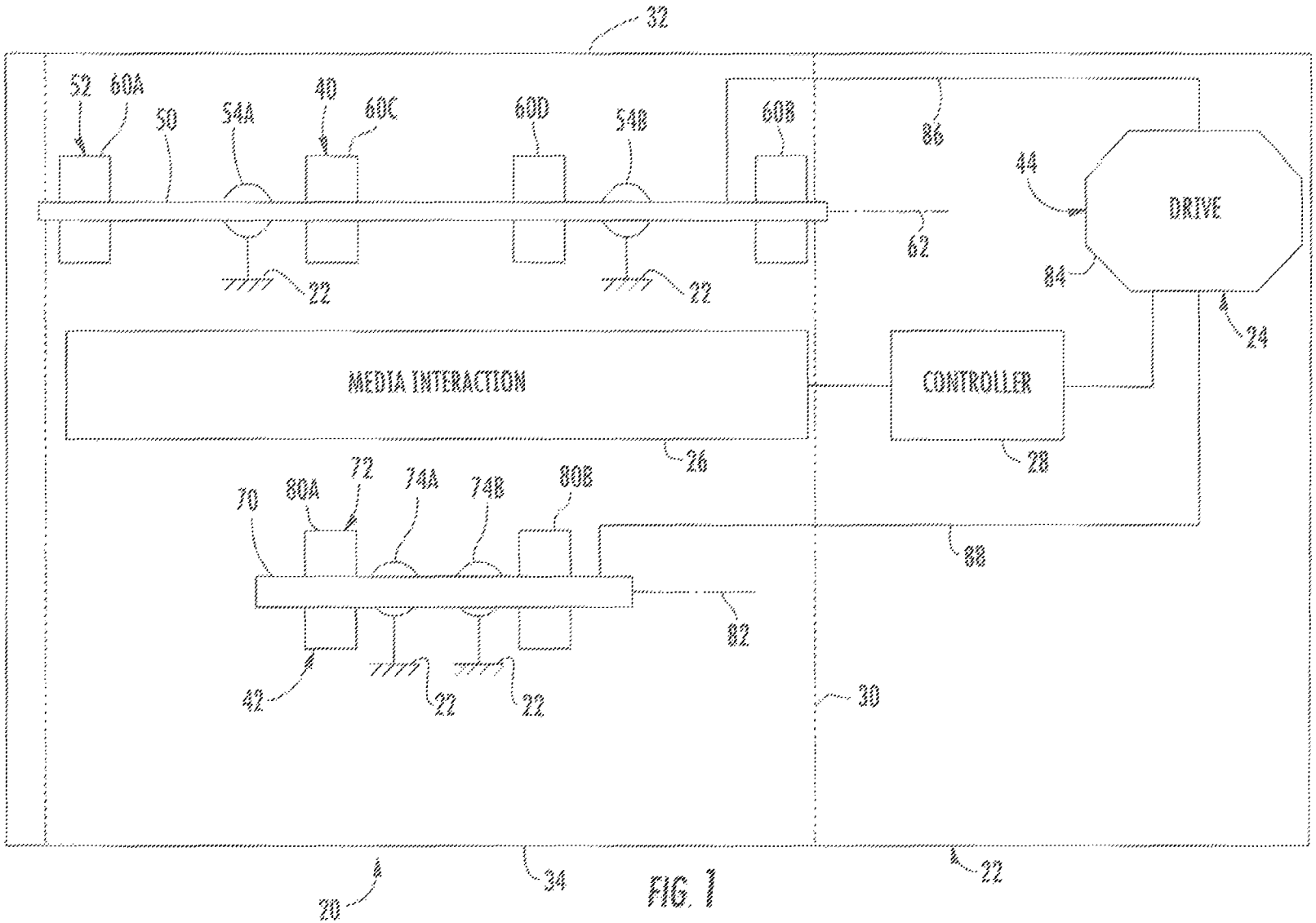
FIG. 1 is a schematic illustration of a media interaction device according to an example embodiment.

FIG. 1 schematically illustrates media interaction device 20 according to an example embodiment. Media interaction device 20 is configured to move sheets of media and to interact with the sheets of media. As will be described hereafter, media interaction device 20 includes features which may reduce the cost and size of device 20.

Media interaction device 20 includes frame or housing 22, media drive system 24, media interaction component 26 and controller 28. Frame or housing 22 comprises one or more structures which serve as a base, foundation and enclosure for a remainder of media interaction device 20. In the example illustrated, housing 22 forms or defines a media path 30 (shown in broken lines). Media path 30 is formed by structures of housing 22 which guide and direct sheets of media along 30 to move sheets of media from an input 32 to media interaction component 26 and from media interaction 26 to an output 34. Input 32 and output 34 may comprise ports or openings by which a person may load, unload or access sheets of media or may comprise ports or openings connected to other external devices or other internal devices also within housing 22.

Media drive system 24 comprises a mechanism or arrangement of components configured to move sheets of media along media path 30. System 24 includes drive units 40, 42 and drive 44. Drive units 40, 42 physically engage or contact a sheet of media to move the sheet of media to and from media interaction component 26. In other embodiments, one of units 40, 42 may be omitted or both of units 40, 42 may alternatively be used for moving or transporting a sheet of media to media interaction component 26 or from media interaction component 26.

Drive unit 40 is located between input 32 and media interaction component 26. Drive unit 40 includes shaft 50, roller set 52 and bearing supports 54A, 54B (collectively referred to as bearing supports 54). Shaft 50 comprises an elongated rod, bar, tube or other structure coupled to roller set 52 and rotationally supported by bearing supports 54. For purposes of this disclosure, the term "coupled" shall mean the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Shaft 50 transmits torque to each of the rollers of roller set 52 to drive sheets of media. As will be described hereafter, the configuration of drive unit 40 permits shaft 50 to have a shorter length and reduced diameter to reduce the cost and size of drive unit 40 as well as device 20.

Roller set 52 comprises a plurality of rollers non-rotationally coupled to shaft 50 such the rotation of shaft 50 also results in rotation of roller set 52. Roller set 52 is supported by shaft 50 opposite to media path 30. Each roller of roller set 52 is configured to frictionally contact and engage a face of a sheet of media and to apply force to the sheet of media so as to move a sheet of media along media path 30. In the example illustrated, roller set 52 includes two outermost rollers 60A, 60B and two inner or intermediate rollers 60C, 60D. In other embodiments, roller set 52 may include a greater or fewer number of such intermediate rollers.

Bearing supports 54 rotationally support shaft 50 for rotation about axis 62. In the example illustrated, bearing supports are coupled to portions of housing 22 and extend into engagement with shaft 50 at locations between outermost rollers 60A and 60B. In other embodiments, bearing supports 54 may alternatively extend from other structures into bearing engagement with shaft 50 at positions between outermost rollers 60A and 60B. In the example illustrated, bearing support 54A is coupled to shaft 50 between roller 60A and roller 60C. Similarly, bearing support 54B is coupled to shaft 50 between roller 60B and roller 60D. In the example embodiment shown, bearing supports 54A and 54B are each positioned as close as possible to rollers 60C and 60D as permissible. Because bearing supports 54 are coupled to shaft 50 between outermost rollers 60A and 60B, deflection of shaft 50 resulting from torque imposed upon shaft 50 by drive 44 and forces imposed upon shaft 50 by rollers 60 is reduced as compared to media drives having rotationally driven shafts which are supported by bearings at axial ends of the driven shaft. As a result, shaft 50 may be provided with a reduced diameter and a shorter length, reducing the cost and size of media drive system 24 and of device 20.

According to one embodiment, bearing supports 54 each comprise V-blocks which hold the shaft 50 while permitting shaft 50 to rotate. In other embodiments, bearing supports 54 may comprise other bearing mechanisms. For example, bearing supports 54 may alternatively comprise fully round or ball bearing type supports.

Although drive unit 40 is illustrated as including two bearing supports, with one bearing support located between rollers 60A and 60B and another bearing support located between rollers 60B and 60D, in other embodiments, drive unit 40 may have greater than or fewer than two such bearings. In yet other embodiments, such bearings may be coupled to shaft 50 at other locations intermediate the outermost rollers 60A and 60B.

Drive unit 42 is located between media interaction component 26 and output 34. Drive unit 42 drives or moves sheets of media from media interaction component 26 to output 34. Drive unit 42 includes shaft 70, roller set 72 and bearing supports 74A, 74B. Shaft 50 comprises and elongate rod, bar, tube or other structure coupled to roller set 72 and rotationally supported by bearing supports 74. Shaft 70 transmits torque to each of the rollers of roller set 72 to drive sheets of media.

As with drive unit 40, the configuration of drive unit 42 permits shaft 70 to have a shorter length and reduced diameter to reduce the cost and size of drive unit 42 as well as device 20.

Roller set 72 comprises a plurality of rollers non-rotationally coupled to shaft 70 such the rotation of shaft 70 also results in rotation of roller set 72. Roller set 72 is supported by shaft 70 opposite to media path 30. Each roller of roller set 72 is configured to frictionally contact and engage a face of a sheet of media and to apply force to the sheet of media so as to move a sheet of media a long media path 30. In the example illustrated, roller set 72 includes two outermost rollers 80A, 80B. In other embodiments, roller set 72 may include intermediate rollers.

Bearing supports 74 rotationally support shaft 70 for rotation about axis 82. In the example illustrated, bearing supports 74 are coupled to portions of housing 22 and extend into engagement with shaft 50 at locations between outermost rollers 80A and 80B. In other embodiments, bearing supports 74 may alternately extend from other structures into bearing engagement with shaft 70 at positions between outermost rollers 80A and 80B. In the example embodiment shown, bearing supports 74A and 74B are each positioned as close as possible to rollers 80A and 80B as permissible. Because bearing supports 74 are coupled to shaft 70 between outermost rollers 80A and 80B, deflection of shaft 70 resulting from torque imposed upon shaft 70 by drive 44 and forces imposed upon shaft 70 by rollers 80 is reduced as compared to media drives having rotationally driven shafts which are supported by bearings at axial ends of the driven shaft. As a result, shaft 70 may be provided with a reduced diameter and a shorter length, reducing the cost and size of media drive system 24 and of device 20.

According to one embodiment, bearing supports 74 each comprise V-blocks which hold the shaft 70 while permitting shaft 70 to rotate. In other embodiments, bearing supports 74 may comprise other bearing mechanisms. For example, bearing supports 74 may alternatively comprise fully round or ball bearing type supports.

Drive 44 comprises a mechanism operably coupled to drive units 40 and 42 so as to rotationally drive shafts 50 and 70 about their respective axes. Drive 44 includes motor 84, power train 86 and power train 88. Motor 84 supplies torque to power trains 86 and 88 to rotationally drive shafts 50 and 70. In one embodiment, motor 84 comprises a DC motor. In other embodiments, motor 84 may comprise other motors or rotary actuators.

Power train 86 comprises a drive train or transmission extending between motor 84 and shaft 50. Power train 86 is operably connected to shaft and 50 at a location between outermost rollers 60A and 60B. According to one embodiment, a portion of power train 86 overlies media path 30 between outermost rollers 60A and 60B. As a result, media drive 44 may be more closely arranged with respect to drive unit 40 and media drive system 24 may be more compact, allowing device 20 to also be more compact.

In one embodiment, power train 86 comprises a gear train extending from an output shaft of motor 84 to shaft 50. In such an embodiment, power train 86 terminates at a gear (not shown) connected or fixed to shaft 50 between outermost a rollers 60A and 60B. The gear has an outer diameter less than the outer diameter of the rollers of roller set 52. As a result, the gear does not interfere with movement of media below roller set 52. In other embodiments, power train 86 may comprise other forms of transmissions. For example, in other embodiments, power train 86 may alternatively include chain and sprocket arrangements, belt and pulley arrangements or combinations of one or more of gear trains, chain and sprocket arrangements, and belt and pulley arrangements. In still other embodiments, power train 86 may be connected to drive unit 42 outside or beyond outermost rollers 60A and 60B.

Power train 88 comprises a drive train or transmission extending between motor 84 and shaft 70. In the particular example illustrated, power train 88 is coupled to shaft 70 beyond or outside of rollers 80A and 80B. As a result, sufficient axial space is provided between such rollers 80A and 80B for two or more bearing supports 74. In other embodiments, power train 88 may alternatively be connected to shaft 70 at locations between rollers 80A and 80B.

In the particular example illustrated, power train 88 comprises a gear train extending from motor 84 to shaft 70 of drive unit 42. In other embodiments, power train 88 may comprise other transmission configurations such as chain and sprocket arrangements, belt and pulley arrangements or combinations of one or more of gear trains, chain and sprocket arrangements, and belt and pulley arrangements. Although power train 88 is schematically illustrated as being distinct from power train 86, in other embodiments, power trains 86 and 88 may share power train components for a portion of their lengths. For example, power trains 86 and 88 may share components such as gears, belt and pulley or chain and sprocket arrangements or a portion of their lengths. Although both drive units 40 and 42 are illustrated as being supplied with torque from motor 84, in other embodiments, drive units 40 and 42 may be individually supplied with torque from separate motors or separate torque sources.

Media interaction component 26 comprises a component configured to interact with a sheet of media so as to modify the sheet of media or obtain information from the sheet of media. For example, in one embodiment, media interaction component 26 may comprise a component configured to modify the appearance of a face or a portion of a face of the sheet of media by printing upon the face of the sheet of media. In another embodiment, the interaction component 26 may comprise a component configured to crease, cut, staple or fold media. In still another embodiment, media interaction component 26 may comprise a component configured to scan, sense or otherwise read and extract information from a sheet or other form of media. For example, in one embodiment, media interaction component 26 comprises a scanner.

As shown by FIG. 1, media interaction component 26 is supported by housing 22 between drive units 40 and 42. Media interaction component 26 receives media positioned by drive unit 40. After media interaction component 26 has interacted with the sheet of media, drive unit 42 withdraw the sheet of media and transfer the sheet of media towards output 34. In other embodiments, media interaction component 26 may have other locations.

Controller 28 comprises one or more processing units configured to generate control signals directing or controlling operation of media drive system 24 and media interaction component 26. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 28 may be embodied as part of one or more application-specific integrated circuits (ASICs). Unless otherwise specifically noted, the controller is not limited to any specific combination of hardware circuitry and software, nor to any particular source for the instructions executed by the processing unit.

In operation, controller 28, following instructions contained in a computer readable medium, generates control signals directing motor 84 to supply torque to shaft 50 so as to rotate shaft 50 and roller set 52 so as to move a sheet of media from input 32 to media interaction component 26. Upon a sheet of media being properly positioned with respect to media interaction component 26, controller 28 generates additional control signals directing media interaction component 26 to appropriately interact with the sheet of media, whether by scanning information from the sheet of media, printing upon the sheet of media, folding, stapling, creasing, cutting or otherwise modifying the sheet of media. Once such interaction is completed, controller 28, generates control signals causing motor 84 to supply torque to drive unit 42 to move the sheet of media towards output 34. As noted above, because bearing supports 54 and 74 are located between the outermost rollers of drive units 40 and 42, shafts 50 and 70 may have a reduced diameter and may be shorter in length, reducing cost and size of such drive units 40 and 42. Because power train 86 is connected to shaft 50 between the outermost rollers of roller set 52, the compactness of device 20 may be further enhanced.

Figure 2:
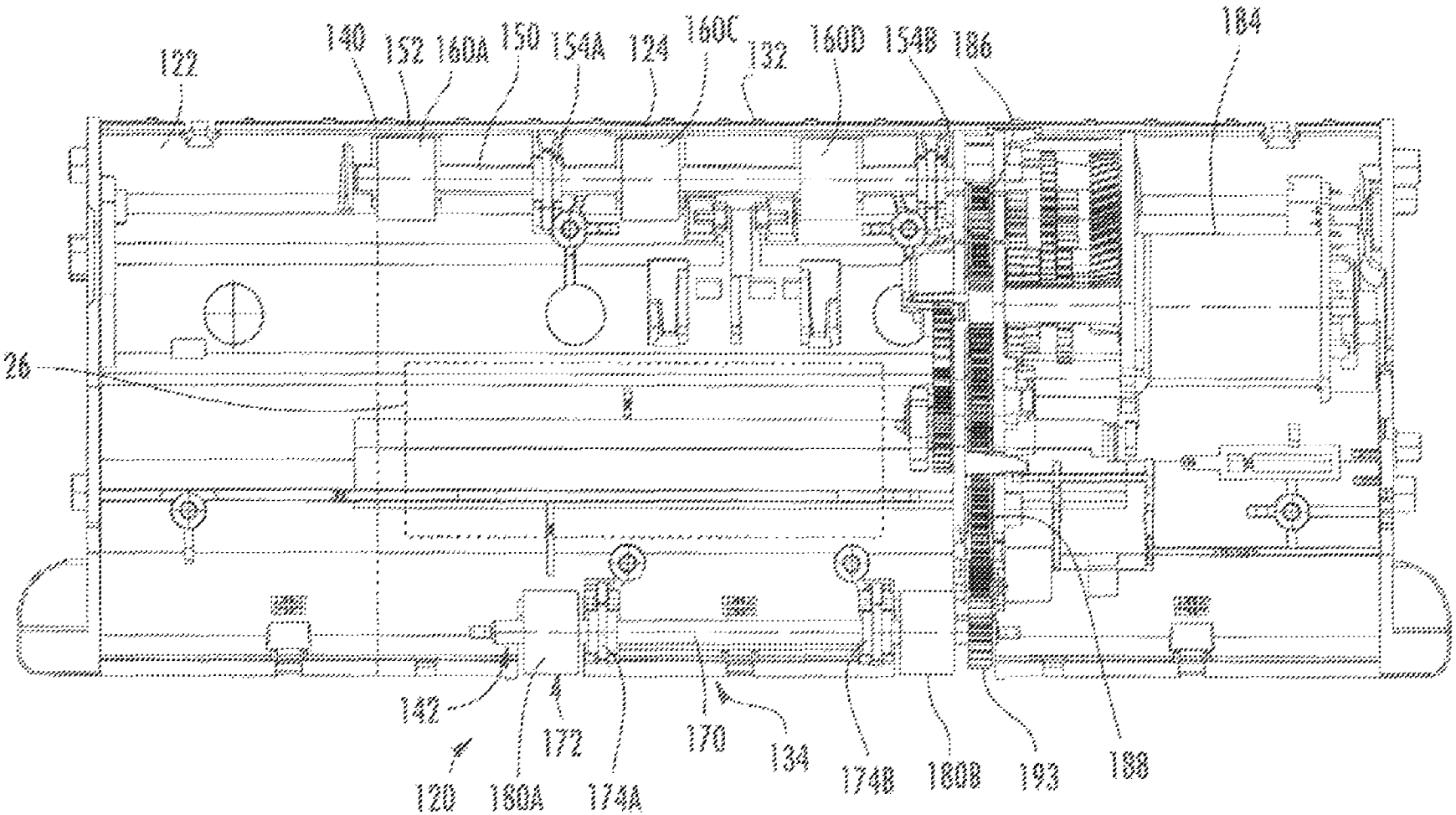
FIG. 2 is a top plan view of another embodiment of the media interaction device of FIG. 1 according to an example embodiment.

FIGS. 2-6 illustrate media interaction device 120, another embodiment of media interaction device 20 shown in FIG. 1. Media interaction device 120 includes a housing 122, media drive system 124, media interaction component 26 (described above with respect to FIG. 1) and controller 28 (shown and described above with respect to FIG. 1). Housing 122 comprises one or more structures which serve as a base, foundation and enclosure for a remainder of media interaction device 120. In the example illustrated, housing 122 forms or defines a media path 130, the left edge of which is shown in FIG. 2. Media path 130 is formed by structures of housing 22 which guide and direct sheets of media along 130 to move sheets of media from an input 132 to media interaction component 26 and from media interaction component 26 to an output 134. Input 132 and output 134 may comprise ports or openings by which a person load, unload or access sheets of media or may comprise ports or openings connected to other external devices or other internal devices also within housing 122.

Media drive system 124 comprises a mechanism or arrangement of components configured to move sheets of media along media path 130. System 124 includes drive units 140, 142 and drive 144. Drive units 140, 142 physically engage or contact a sheet of media to move the sheet of media to and from media interaction component 26. In other embodiments, one of units 140, 142 may be omitted or both of units 140, 142 may alternatively be used for moving or transporting sheet of media to media interaction component 26 or from media interaction component 26.

Drive unit 140 is located between input 132 and media interaction component 26. Drive unit 140 includes shaft 50, roller set 152 and bearing supports 154A, 154B (collectively referred to as bearing supports 154). Shaft 150 comprises an elongate rod coupled to roller set 152 and rotationally supported by bearing supports 154. Shaft 150 transmits torque to each of the rollers of roller set 152 to drive sheets of media. As will be described hereafter, the configuration of drive unit 140 permits shaft 150 to have a shorter length and reduced diameter to reduce the cost and size of drive unit 140 as well as device 120.

Roller set 152 comprises a plurality of rollers non-rotationally coupled to shaft 150 such that the rotation of shaft 150 also results in rotation of roller set 152. Roller set 152 is supported by shaft 150 opposite to media path 130. Each roller of roller set 152 is configured to frictionally contact and engage a face of a sheet of media and to apply force to the sheet of media so as to move a sheet of media a long media path 130. In the example illustrated, roller set 152 includes two outermost rollers 160A, 160B and two inner or intermediate rollers 160C, 160D. In other embodiments, roller set 152 may include a greater or fewer number of such intermediate rollers.

Bearing supports 154 rotationally support shaft 150 for rotation about axis 162. In the example illustrated, bearing supports 154 coupled to portions of housing 122 and extend into engagement with shaft 150 at locations between outermost rollers 160A and 160B. In other embodiments, bearing supports 154 may alternatively extend from other structures into bearing engagement with shaft 150 at positions between outermost rollers 160A and 160B. In the example illustrated, bearing support 154A is coupled to shaft 150 between roller 160A and roller 160C. Similarly, bearing support 154B is coupled to shaft 150 between roller 160B and roller 160D. In the example embodiment shown, bearing supports 154A and 154B are equidistantly spaced from roller 160C and 160D. In the example illustrated, bearing supports 154A and 154B are each positioned as close as possible to rollers 160C and 160D ad permissible. Because bearing supports 154 are coupled to shaft 50 between outermost rollers 160A and 160B, deflection of shaft 150 resulting from torque imposed upon shaft 150 by drive 144 and forces imposed upon shaft 150 by rollers 160 is reduced as compared to media drives having rotationally driven shafts which are supported by bearings at axial ends of the driven shaft. As a result, shaft 150 may be provided with a reduced diameter and a shorter length, reducing the cost and size of media drive 124 and of device 120.

According to one embodiment, shaft 150 has a length of approximately 0.138 m. Rollers 160C and 160D have axial center lines axially spaced from an axial midpoint of shaft 150 by about 0.0153 m. Rollers 160A and 160B have axial midpoints spaced from an actual midpoint of shaft 150 by about 0.058 m. Gear 189 has an axial midpoint spaced from an axial midpoint of shaft 150 by approximately 0.0419 m. Shaft 150 has a diameter of approximately 0.004 m. In the example embodiments shown, relocation of bearing supports 154 from outside roller 160A and 160B to the locations illustrated in FIG. 2 permit a 50 percent reduction in shaft diameter and reduced a width of device 120 by at least about 50 mm. In other embodiments, drive unit 140 may have other dimensions and configurations.

According to one embodiment, bearing supports 154 each comprise V-blocks which hold the shaft 150 while permitting shaft 150 to rotate. In other embodiments, bearing supports 154 may comprise other bearing mechanisms.

Although drive unit 140 is illustrated as including two bearing supports, with one bearing support located between rollers 160A and 160B and another bearing support located between rollers 160B and 160D, in other embodiments, drive unit 140 may have greater than or fewer than two such bearing supports. In yet other embodiments, such bearings may be coupled to shaft 150 at other locations intermediate the outermost rollers 160A and 160B.

Drive unit 142 is located between media interaction component 26 and output 134. Drive unit 142 drives or moves sheets of media from media interaction component 26 to output 134. Drive unit 142 includes shaft 170, roller set 172 and bearing supports 174A, 174B. Shaft 150 comprises an elongate rod, bar, tube or other structure coupled to roller set 172 and rotationally supported by bearing supports 174. Shaft 170 transmits torque to each of the rollers of roller set 172 to drive sheets of media. As with drive unit 140, the configuration of drive unit 142 permits shaft 170 to have a shorter length and reduced diameter to reduce the cost and size of drive unit 142 as well as device 120.

Roller set 172 comprises a plurality of rollers non-rotationally coupled to shaft 170 such the rotation of shaft 170 also results in rotation of roller set 172. Roller set 172 is supported by shaft 170 opposite to media path 130. Each roller of roller set 172 is configured to frictionally contact and engage a face of a sheet of media and to apply force to the sheet of media so as to move a sheet of media a long media path 130. In the example illustrated, roller set 172 includes two outermost rollers 180A, 180B (shown in FIG. 3). In other embodiments, roller set 172 may include intermediate rollers.

Bearing supports 174 rotationally support shaft 170 for rotation about axis 182. In the example illustrated, bearing supports 174 are coupled to portions of housing 122 and extend into engagement with shaft 150 at locations between outermost rollers 180A and 180B. In other embodiments, bearing supports 174 may alternately extend from other structures into bearing engagement with shaft 170 at positions between outermost rollers 180A and 180B. In the example embodiment shown, bearing supports 174A and 174B are each positioned as close as possible to rollers 180A and 180B as permissible. Because bearing supports 174 are coupled to shaft 170 between outermost rollers 180A and 180B, deflection of shaft 170 resulting from torque imposed upon shaft 170 by drive 144 and forces imposed upon shaft 170 by rollers 180 is reduced as compared to media drives having rotationally driven shafts which are supported by bearings at axial ends of the driven shaft. As a result, shaft 70 may be provided with a reduced diameter and a shorter length, reducing the cost and size of media drive 124 and of device 120.

In the example illustrated, bearing supports 174 each comprise V-blocks which hold the shaft 170 while permitting shaft 170 to rotate. In other embodiments, bearing supports 174 may comprise other bearing mechanisms.

Drive 144 comprises a mechanism operably coupled to drive units 140 and 142 so as to rotationally drive shafts 150 and 170 about their respective axes. Drive 44 includes motor 184, power train 186 and power train 188. Motor 84 supplies torque to power train 186 to rotationally drive shafts 150 and 170. In one embodiment, motor 84 comprises a DC motor. In other embodiments, motor 184 may comprise other motors or rotary actuators.

As shown in more detail in FIGS. 3-6, power train 186 comprises a drive train or transmission extending between motor 184 and shaft 150. Power train 186 is operably connected to shaft 150 at a location between outermost rollers 160A and 160B. According to one embodiment, a portion of power train 186 overlies media path 130 between outermost rollers 160A and 160B. As a result, media drive 144 may be more closely arranged with respect to drive unit 40 and media drive system 24 may be more compact, allowing device 120 to also be more compact.

Figure 3:
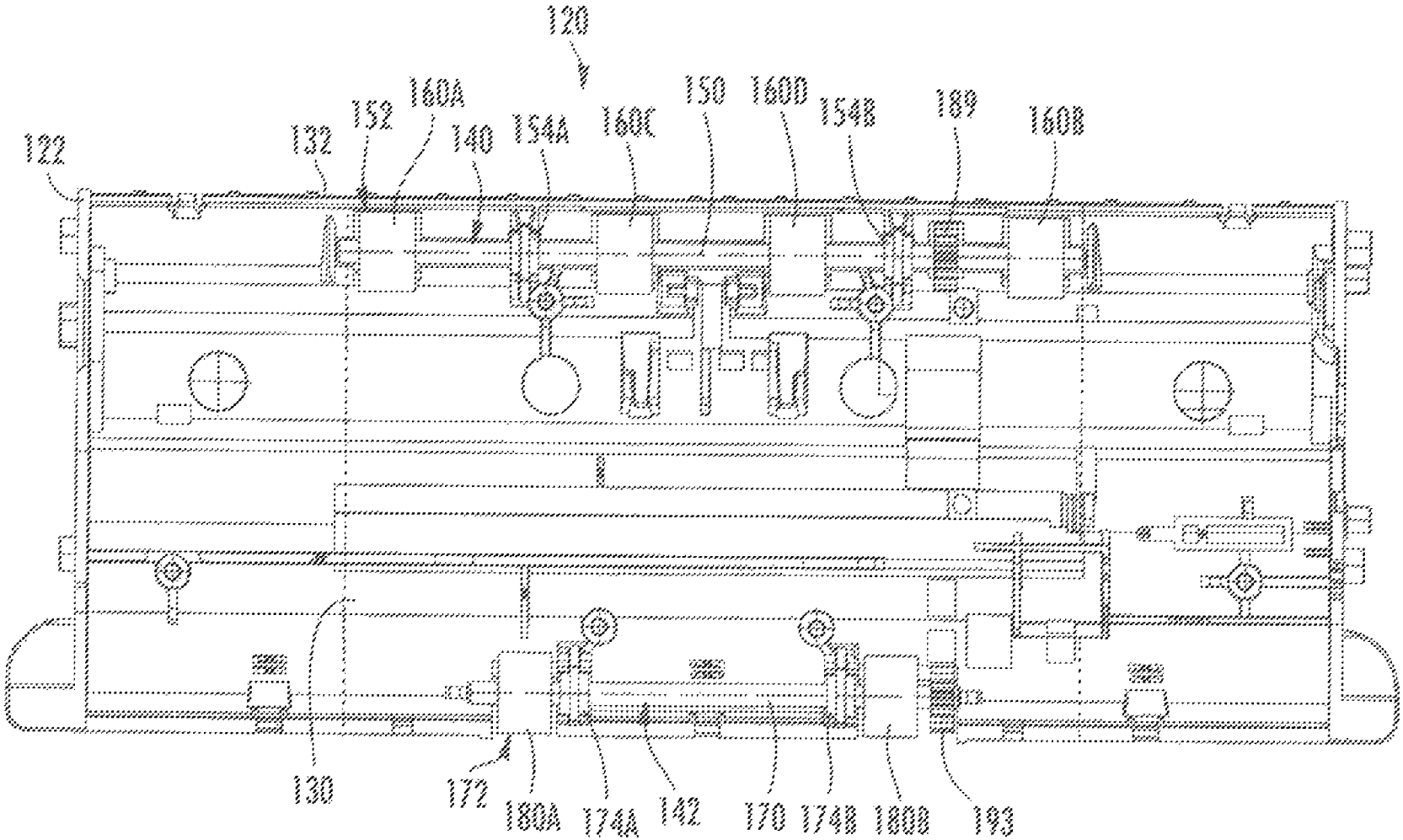
FIG. 3 is a top plan view of the media interaction device of FIG. 2 with portions removed for purposes of illustration according to an example embodiment.

In the embodiment illustrated, power train 186 comprises a gear train extending from an output shaft of motor 184 to shaft 150. In such an embodiment, power train 186 terminates at gear 189 connected or fixed to shaft 150 between outermost a rollers 60A and 160B. FIG. 3 illustrates all but terminal gear 189 removed to illustrate the overlapping of power train 186 over and above media path 130. The gear 189 has an outer diameter less that the outer diameter of the rollers of roller set 152. As a result, gear 189 does not interfere with movement of media below roller set 152. In other embodiments, power train 86 may comprise other forms of transmissions. For example, in other embodiments, power train 186 may alternatively include chain and sprocket arrangements, belt and pulley arrangements or combinations of one or more of gear trains, chain and sprocket arrangements, and belt and pulley arrangements. In still other embodiments, power train 186 may be connected to drive unit 142 outside or beyond outermost rollers 160A and 160B.

Figure 4:
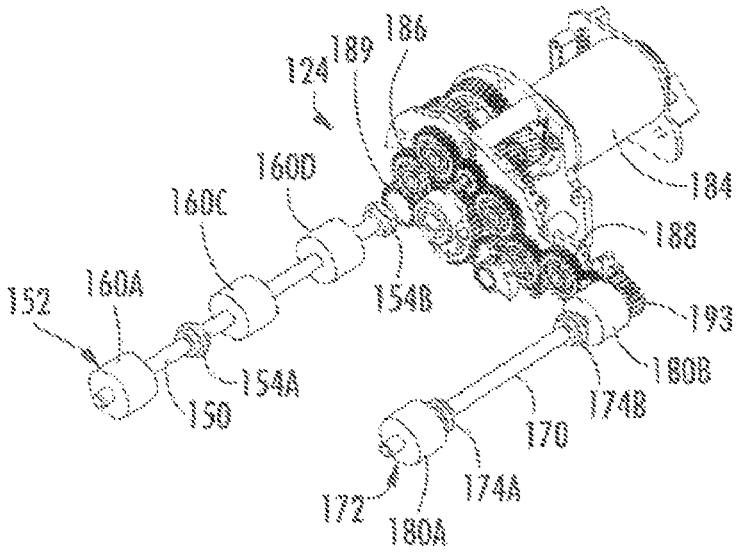
FIG. 4 is a top perspective view of a media drive system of the device of FIG. 2 according to an example embodiment.
Figure 5:
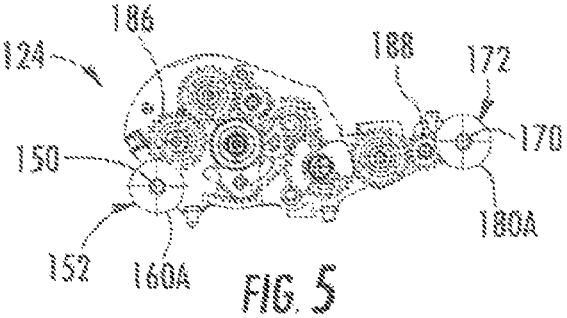
FIG. 5 is a left end elevation of view of the media drive system of FIG. 4 according to an example embodiment.
Figure 6:
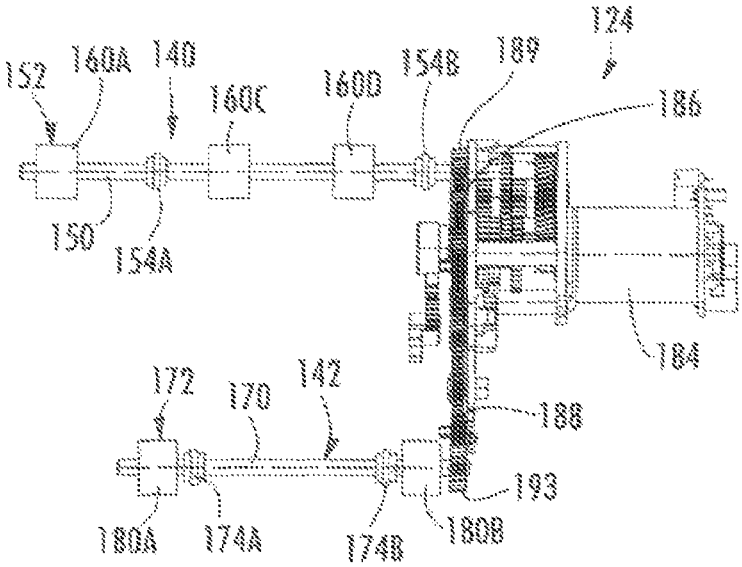
FIG. 6 is a top plan view of the media drive system of FIG. 4 according to an example embodiment.

Power train 188 comprises a drive train or transmission extending between motor 84 and shaft 170. As shown by FIG. 4, power train 188 terminates at a gear 193 affixed to shaft 170. In the particular example illustrated, power train 188 is coupled to shaft 170 beyond or outside of rollers 180A and 180B. As a result, sufficient axial space is provided between such rollers 180A and 180B for two or more bearing supports 174. In other embodiments, power train 188 may alternatively be connected to shaft 170 at locations between rollers 180A and 180B.

In the particular example illustrated, power train 188 comprises a gear train extending from motor 184 to shaft 170 of drive unit 142. In other embodiments, power train 188 may comprise other transmission configurations such as chain and sprocket arrangements, belt and pulley arrangements or combinations of one or more of gear trains, chain and sprocket arrangements, and belt and pulley arrangements. In the example illustrated, power train 86 shares components with power train 188 for portion of its length. Although both drive units 140 and 142 are illustrated as being supplied with torque from motor 184, in other embodiments, drive units 140 and 142 may be individually supplied with torque from separate motors or separate torque sources.

Media interaction component 26 and controller 28 are each described above with respect to media interaction device 20. In the particular example illustrated, media interaction component 26 comprises a scanner, such that drive unit 140 comprises a pre-scan roller unit and drive unit 142 comprises a post-scan roller unit. In other embodiments, media interaction component 126 may comprise other components configured to interact with media in other fashions.

As with media drive system 24, media drive system 124 is configured such that media drive system 124 may be less expensive and more compact. Locating bearing supports and 154 and 174 inwards of the outermost rollers 160A, 160B and outermost rollers 180A, 180B, respectively, allows shafts 150 and 170 to be shorter in length and to have a reduced diameter. By connecting power train 186 to shaft 150 between outermost rollers 160A and 160B, the compactness of media drive 124 is further increased. In other embodiments, these two features which enhance compactness or reduce the size of media drive 124 may be used independent of one another.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A media drive system comprising:

a first shaft;

a first set of rollers supported by the first shaft, the first set of rollers including first two outermost rollers, wherein each of the first two outermost rollers has an outer curved surface located to contact a face of a medium to drive the medium upon rotation of the first shaft;

a drive operably coupled to the first shaft to rotate the first shaft; and a first bearing support coupled to the first shaft between the first outermost rollers: and wherein the first set of rollers include at least one intermediate roller supported on the first shaft such that the at least one intermediate roller includes a first intermediate roller and a second intermediate roller solely supported by bearing supports located outside the first and second intermediate rollers and between the first outermost rollers.

2. The system of claim 1, wherein the drive is operably coupled to the first shaft between the first outermost rollers.

3. The system of claim 2, wherein the drive includes a gear between the first outermost rollers and wherein the first outermost rollers have a first diameter and wherein the gear has a second lesser diameter.

4. The system of claim 1, wherein the first shaft is solely supported by bearing supports located between the first outermost rollers.

5. The system of claim 1 further comprising a second bearing support, wherein the first bearing support and the second bearing support are equidistantly spaced from the first outermost rollers.

6. The system of claim 1, wherein the drive is operably coupled to the first shaft between the first outermost rollers.

7. The system of claim 6, wherein the drive includes a gear between the first outermost rollers and wherein the first outermost rollers have a first diameter and wherein the gear has a second lesser diameter.

8. The system of claim 7 further comprising a second bearing support, wherein the first bearing support and the second bearing support are equidistantly spaced from the first outermost rollers.

9. The system of claim 1, wherein the drive is operably coupled to the shaft at a location above a media feed path.

10. The system of claim 1 further comprising a scanner configured to scan a sheet of media between the first outermost rollers.

11. The system of claim 1 further comprising a media interaction component configured to interact with a sheet of media so as to perform at least one of printing, scanning, creasing, cutting, stapling or folding the sheet of media, wherein the first set of rollers are configured to move the sheet of media with respect to the media interaction component.

12. A media drive system comprising:

a first shaft;

a first set of rollers supported by the first shaft, the first set of rollers including first two outermost rollers, wherein each of the first two outermost rollers has an outer curved surface located to contact a face of a medium to drive the medium upon rotation of the first shaft;

a drive operably coupled to the first shaft to rotate the first shaft;

a first bearing support coupled to the first shaft between the first outermost rollers;

a second shaft operably coupled to the drive;

a second set of rollers supported by the second shaft, the second set including a second two axial outermost rollers;

a media interaction component between the first shaft and the second shaft; and a second bearing support coupled to a second shaft between the second two axial outermost rollers.

13. The system of claim 12, wherein the media interaction component comprises a scanner.

14. The system of claim 12, wherein the second shaft is solely supported by one or more bearing supports, including the second bearing support, between the second two outermost rollers.

15. A media drive system comprising:

a first shaft; a first set of rollers supported by the first shaft, the first set of rollers including first two outermost rollers, wherein each of the first two outermost rollers has an outer curved surface located to contact a face of a medium to drive the medium upon rotation of the first shaft;

a drive operably coupled to the first shaft to rotate the first shaft;

a first bearing support coupled to the first shaft between the first outermost rollers;

a second shaft operably coupled to the drive;

a second set of rollers supported by the second shaft, the second set including a second two axial outermost rollers; and a media interaction component between the first shaft and the second shaft; and wherein the drive is operably coupled to the second shaft outwards the second two outermost rollers.

* * * * *

UNITED STATES PATENT AND TRADEMARK OFFICE

CERTIFICATE OF CORRECTION

PATENT NO. : 8,243,344 B2
APPLICATION NO. : 11/618313
DATED : August 14, 2012
INVENTOR(S) : Kevin L. Bokelman et al.

It is certified that error appears in the above-identified patent and that said Letters Patent is hereby corrected as shown below:

On the title page, in item (56), under "U.S. PATENT DOCUMENTS", in column 1, line 2, delete "402,776" and insert -- 4,027,765 --, therefor.

On the title page, in item (56), under "U.S. PATENT DOCUMENTS", in column 2, line 1, delete "448,836" and insert -- 4,488,367 --, therefor.

On the title page, in item (56), under "U.S. PATENT DOCUMENTS", in column 2, line 4, delete "519,970" and insert -- 5,199,702 --, therefor.

On the title page, in item (56), under "U.S. PATENT DOCUMENTS", in column 2, line 5, delete "520,674" and insert -- 5,206,745 --, therefor.

On the title page, in item (56), under "U.S. PATENT DOCUMENTS", in column 2, line 6, delete "527,653" and insert -- 5,276,536 --, therefor.

On the title page, in item (56), under "U.S. PATENT DOCUMENTS", in column 2, line 8, delete "566,157" and insert -- 5,661,572 --, therefor.

On the title page, in item (56), under "U.S. PATENT DOCUMENTS", in column 2, line 11, delete "573,992" and insert -- 5,739,925 --, therefor.

On the title page, in item (56), under "U.S. PATENT DOCUMENTS", in column 2, line 12, delete "576,092" and insert -- 5,760,926 --, therefor.

On the title page, in item (56), under "U.S. PATENT DOCUMENTS", in column 2, line 13, delete "589,620" and insert -- 5,896,206 --, therefor.

On the title page, in item (56), under "U.S. PATENT DOCUMENTS", in column 2, line 14, delete "600,280" and insert -- 6,002,805 --, therefor.

Signed and Sealed this
Seventh Day of May, 2013

Teresa Stanek Rea

Teresa Stanek Rea
*Acting Director of the United States Patent and Trademark Office*

On the title page, in item (56), under "U.S. PATENT DOCUMENTS", in column 2, line 15, delete "602,593" and insert -- 6,025,936 --, therefor.

On the title page, in item (56), under "U.S. PATENT DOCUMENTS", in column 2, line 18, delete "618,540" and insert -- 6,185,405 --, therefor.

On the title page, in item (56), under "U.S. PATENT DOCUMENTS", in column 2, line 19, delete "630,765" and insert -- 6,307,650 --, therefor.

On the title page, in item (56), under "U.S. PATENT DOCUMENTS", in column 2, line 21, delete "703,103" and insert -- 7,031,032 --, therefor.

On the title page, in item (56), under "U.S. PATENT DOCUMENTS", in column 2, line 21, delete "Westeoft et al." and insert -- Westcott et al. --, therefor.

In the Claims:

In column 9, line 12, in Claim 1, delete "rollers:" and insert -- rollers; --, therefor.